US011393369B2

(12) United States Patent
Wang

(10) Patent No.: US 11,393,369 B2
(45) Date of Patent: Jul. 19, 2022

(54) OVERCURRENT PROTECTION MODULE AND DISPLAY DEVICE

(71) Applicant: HKC CORPORATION LIMITED, Shenzhen (CN)

(72) Inventor: Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 65 days.

(21) Appl. No.: 17/059,240

(22) PCT Filed: Jan. 10, 2019

(86) PCT No.: PCT/CN2019/071114

§ 371 (c)(1),
(2) Date: Nov. 26, 2020

(87) PCT Pub. No.: WO2020/133582

PCT Pub. Date: Jul. 2, 2020

(65) Prior Publication Data

US 2021/0209978 A1 Jul. 8, 2021

(30) Foreign Application Priority Data

Dec. 27, 2018 (CN) ..... 201811610770.2

(51) Int. Cl.
*G09G 3/00* (2006.01)
*G09G 3/36* (2006.01)

(52) U.S. Cl.
CPC ..... *G09G 3/006* (2013.01); *G09G 3/3696* (2013.01); *G09G 2310/0286* (2013.01); *G09G 2330/025* (2013.01); *G09G 2330/04* (2013.01)

(58) Field of Classification Search
CPC ..... G09G 3/006; G09G 3/3696; G09G 2310/0286; G09G 2330/025; G09G 2330/04
See application file for complete search history.

(56) References Cited

U.S. PATENT DOCUMENTS 4,641,105 A 2/1987 Albaugh et al.
2004/0070908 A1 4/2004 Corcoran et al.
(Continued)

FOREIGN PATENT DOCUMENTS

CN 101598952 A 12/2009
CN 101661057 A 3/2010
(Continued)

OTHER PUBLICATIONS

First Office Action in counterpart Chinese Patent Application No. 201811610770.2, dated Jan. 3, 2020.
(Continued)

*Primary Examiner* — Chanh D Nguyen
*Assistant Examiner* — Ngan T. Pham-Lu
(74) *Attorney, Agent, or Firm* — Westbridge IP LLC

(57) ABSTRACT

The present application relates to an overcurrent protection module, comprising a first output terminal, a detection circuit, a first conversion circuit, and a main control circuit. The first output terminal is used for outputting a drive signal; the detection circuit is used for detecting an output current of the first output terminal; the first conversion circuit is used for converting the output current into a voltage, and the voltage comprises a first voltage and a second voltage; the main control circuit is used for transmitting a control signal to control the first conversion circuit to transmit the first voltage or the second voltage to the main control circuit; the main control circuit is further used for calculating an effective value of the output current according to the first voltage and the second voltage, and controlling the output of the drive signal from the first output terminal.

18 Claims, 4 Drawing Sheets

(56) References Cited

U.S. PATENT DOCUMENTS

| | | | | |
|---|---|---|---|---|
| 2014/0267206 | A1 | 9/2014 | Takani et al. | |
| 2020/0020299 | A1* | 1/2020 | Xu | G09G 5/008 |
| 2020/0150573 | A1* | 5/2020 | Izaki | G03G 15/2053 |

FOREIGN PATENT DOCUMENTS

| | | | | |
|---|---|---|---|---|
| CN | 101676987 | A | | 3/2010 |
| CN | 101840662 | A | | 9/2010 |
| CN | 101896035 | A | | 11/2010 |
| CN | 106802195 | A | | 6/2017 |
| CN | 106847186 | A | | 6/2017 |
| CN | 107395006 | A | | 11/2017 |
| CN | 108767810 | A | * | 11/2018 |
| CN | 109064985 | A | | 12/2018 |

OTHER PUBLICATIONS

International Search Report and Written Opinion in corresponding PCT Application No. PCT/CN2019/071114, dated Sep. 2, 2019.
Second Office Action in counterpart Chinese Patent Application No. 201811610770.2, dated Sep. 9, 2020.

* cited by examiner

OVERCURRENT PROTECTION MODULE AND DISPLAY DEVICE

CROSS-REFERENCE TO RELATED APPLICATIONS

This application is the national stage of International Application No. PCT/CN2019/071114, filed on Jan. 10, 2019, which claims priority to Chinese Patent Application No. 201811610770.2, filed in the China Patent Office on Dec. 27, 2018, entitled "Overcurrent Protection Module and Display Device", the entire content of which is hereby incorporated by reference.

TECHNICAL FIELD

The present disclosure relates to the technical field of display, in particular to an overcurrent protection module and a display device.

BACKGROUND

The statements herein only provide background information related to this application and does not necessarily constitute prior art.

With the increasing demand for narrow frame TVs, GDL (Gate driver less) display panels become more and more popular. The GDL architecture consists of two parts: a boost system and a shift register. The boost system is disposed on the drive board, and the shift register is disposed on the drive board of the display panel. The boost system transmits CLK (Clock) signals to the shift register to complete the drive of the display panel. The boost system is disposed on the drive board so that the frame width of the display panel can be reduced.

Due to defects from manufacturing process, the liquid crystal display panel may burn down due to excessive drive current. The existing boost system usually detects the drive current output at its output terminal as follows: no detection is made at the moment when high and low levels of the drive signal are switched, because the instantaneous current at this moment is larger and the drive current is detected after the high and low levels of the drive signal are switched for a certain period of time, thus the detected drive current cannot reflect the real state of the drive current output at the output terminal of the boost system, thereby the display panel cannot be effectively protected when the drive current is abnormal.

SUMMARY

According to various embodiments of the present application, an overcurrent protection module and a display device are provided.

According to one aspect of the present application, an overcurrent protection module is provided and includes:

a first output terminal configured to output a drive signal;

a detection circuit connected with the first output terminal and configured to detect an output current of the first output terminal;

a first conversion circuit connected with the detection circuit and configured to convert the output current to a voltage, where the voltage includes a first voltage and a second voltage; and a main control circuit connected with the first conversion circuit and configured to transmit a control signal to control the first conversion circuit to transmit the first voltage or the second voltage to the main control circuit;

where the main control circuit is further configured to calculate an effective value of the output current according to the first voltage and the second voltage, and control the output of the drive signal at the first output terminal according to the effective value.

In one embodiment, the main control circuit is further configured to control the first output terminal to stop outputting the drive signal when the effective value is greater than a preset value.

In one embodiment, the detection circuit includes a first terminal and a second terminal, the first conversion circuit includes a first switch, a second switch, a third switch, a fourth switch and a first detection circuit; The first detection circuit includes:

a first input terminal connected with the first terminal of the detection circuit through the first switch and connected with the second terminal of the detection circuit through the second switch;

a second input terminal connected with the second terminal of the detection circuit through the third switch and connected with the first terminal of the detection circuit through the fourth switch; and a second output terminal connected with the main control circuit;

the control signal includes a first control signal and a second control signal;

the first control signal is configured to control the first switch and the third switch to turn on, and control the second switch and the fourth switch to turn off, the first detection circuit is configured to convert the output current to the first voltage and transmit the first voltage to the main control circuit;

the second control signal is configured to control the first switch and the third switch to turn off, and control the second switch and the fourth switch to turn on, and the first detection circuit is configured to convert the output current to the second voltage and transmit the second voltage to the main control circuit.

In one embodiment, the detection circuit includes a first terminal and a second terminal; the first conversion circuit includes a fifth switch, a sixth switch, a second detection circuit and a third detection circuit;

the second detection circuit includes:

a third input terminal connected to the first terminal of the detection circuit;

a fourth input terminal connected to the second terminal of the detection circuit; and a third output terminal connected with the main control circuit through the fifth switch;

the third detection circuit includes:

a fifth input terminal connected to the second terminal of the detection circuit;

a sixth input terminal connected to the first terminal of the detection circuit; and a fourth output terminal connected with the main control circuit through the sixth switch;

the control signal includes a first control signal and a second control signal;

the first control signal is configured to control the fifth switch to turn on and the sixth switch to turn off, and the second detection circuit is configured to convert the output current to the first voltage and transmit the first voltage to the main control circuit;

the second control signal is configured to control the fifth switch to turn off and the sixth switch to turn on, and the third detection circuit is configured to convert the output current to the second voltage and transmit the second voltage to the main control circuit.

In one embodiment, the first detection circuit includes an operational amplifier, a first resistor, a second resistor, a third resistor and a fourth resistor; a non-inverting input terminal of the operational amplifier is connected with a first terminal of the first resistor, a second terminal of the first resistor is connected with the first terminal of the detection circuit, the non-inverting input terminal of the operational amplifier is grounded through the second resistor, an inverting input terminal of the operational amplifier is connected with a first terminal of the third resistor, a second terminal of the third resistor is connected to the second terminal of the detection circuit, the inverting input terminal of the operational amplifier is connected with an output terminal of the operational amplifier through the fourth resistor, the second terminal of the first resistor serving as the first input terminal of the first detection circuit, the second terminal of the third resistor serving as the second input terminal of the first detection circuit, and the output terminal of the operational amplifier serving as the second output terminal of the first detection circuit.

In one embodiment, the second detection circuit includes an operational amplifier, a first resistor, a second resistor, a third resistor and a fourth resistor; a non-inverting input terminal of the operational amplifier is connected with a first terminal of the first resistor, a second terminal of the first resistor is connected to the first terminal of the detection circuit, the non-inverting input terminal of the operational amplifier is grounded through the second resistor, an inverting input terminal of the operational amplifier is connected with a first terminal of the third resistor, a second terminal of the third resistor is connected to the second terminal of the detection circuit, the inverting input end of the operational amplifier is also connected with an output end of the operational amplifier through the fourth resistor, the second terminal of the first resistor serving as the third input terminal of the second detection circuit, the second terminal of the third resistor serving as the fourth input terminal of the second detection circuit, and the output terminal of the operational amplifier serving as the third output terminal of the second detection circuit.

In one embodiment, the third detection circuit includes an operational amplifier, a first resistor, a second resistor, a third resistor, and a fourth resistor; a non-inverting input terminal of the operational amplifier is connected with a first terminal of the first resistor, a second terminal of the first resistor is connected to the first terminal of the detection circuit, the non-inverting input terminal of the operational amplifier is grounded through the second resistor, an inverting input terminal of the operational amplifier is connected with a first terminal of the third resistor, a second terminal of the third resistor is connected to the second terminal of the detection circuit, the inverting input terminal of the operational amplifier is connected with an output terminal of the operational amplifier through the fourth resistor, the second terminal of the first resistor serving as the fifth input terminal of the third detection circuit, the second terminal of the third resistor serving as the sixth input terminal of the third detection circuit, and the output terminal of the operational amplifier serving as the fourth output terminal of the third detection circuit.

In one embodiment, an analog-to-digital converter is also included, the analog-to-digital converter is connected with the first conversion circuit and the main control circuit and configured to convert the first voltage or the second voltage which is an analog voltage to a digital signal and transmit the digital signal to the main control circuit.

In one embodiment, the main control circuit includes a calculation device connected to the analog-to-digital converter and configured to calculate the effective value of the output current based on the digital signal.

In one embodiment, the main control circuit further includes a controller configured to control the output of the drive signal at the first output terminal according to the effective value.

In one embodiment, the overcurrent protection module further includes:

a signal input terminal configured to receive a low potential logic signal; and a second conversion circuit connected with the signal input terminal through the main control circuit, the second conversion circuit being connected with the detection circuit, and configured to convert the low potential logic signal to a high potential drive signal and transmit the high potential logic signal to the first output terminal through the detection circuit.

In one embodiment, an absolute value of a potential of the drive signal is greater than an absolute value of a potential of the low potential logic signal.

In one embodiment, the detection circuit is a sampling resistor.

In one embodiment, the main control circuit is a microcontroller.

In one embodiment, a resistance value of the first resistor is equal to a resistance value of the second resistor.

In one embodiment, a resistance value of the third resistor is equal to a resistance value of the fourth resistor.

According to another aspect of the present application, an overcurrent protection module is provided and includes:

a first output terminal configured to output a drive signal;

a detection circuit connected with the output terminal and configured to detect an output current of the first output terminal;

a first conversion circuit connected with the detection circuit and configured to convert the output current to a voltage, wherein the voltage includes a first voltage and a second voltage;

a main control circuit connected with the first conversion circuit and configured to transmit a control signal to control the first conversion circuit to transmit the first voltage or the second voltage to the main control circuit; and an analog-to-digital converter connected with the first conversion circuit and the main control circuit, and configured to convert the first voltage or the second voltage which is an analog voltage to a digital signal and transmit the digital signal to the main control circuit;

where the main control circuit is further configured to calculate an effective value of the output current according to the first voltage and the second voltage, and control the output of the drive signal at the first output terminal according to the effective value.

According to still another aspect of the present application, a display device is provided and includes a boost system, a drive circuit board, a display panel and a shift register. The boost system includes the above mentioned overcurrent protection module. The boost system is disposed on the drive circuit board, and the shift register is disposed on both sides of the display panel.

Details of one or more embodiments of the present application are set forth in the following drawings and description. Other features, objects, and advantages of the present application will become apparent from the specification, the accompanying drawings, and the appended claims.

BRIEF DESCRIPTION OF THE DRAWINGS

In order to explain more clearly the embodiments of the present application or the technical solutions in the related art, a brief description of the accompany drawings need to be used in the description of the embodiments or the related art is made. It is apparent that the drawings in the following description are only some of the embodiments of the present application. Based on those drawings, those ordinary skilled in the art can obtain drawings of other embodiments without creative effort.

DETAILED DESCRIPTION OF THE EMBODIMENTS

For ease of understanding, the present application will be described more fully below with reference to the accompanying drawings. Preferred embodiments of the present application are shown in the accompanying drawings. However, the present application may be implemented in many different forms and is not limited to the embodiments described herein. On the contrary, the embodiments are provided for the purpose of making the disclosure of this application more thorough and comprehensive.

Unless otherwise defined, all technical and scientific terms used herein have the same meanings as generally understood by those skilled in the art of the present application. Terms used herein in the specification of the present application are for the purpose of describing specific embodiments only and are not intended to limit the present application. As used herein, the term "and/or" includes any and all combinations of one or more related listed items.

It should be noted that when one element is considered to be "connected" to another element, it may be directly connected to the another element or there may be an intermediate element at the same time.

The detailed description of the embodiments of the present invention is made below in combination with the accompanying drawings.

Figure 1:
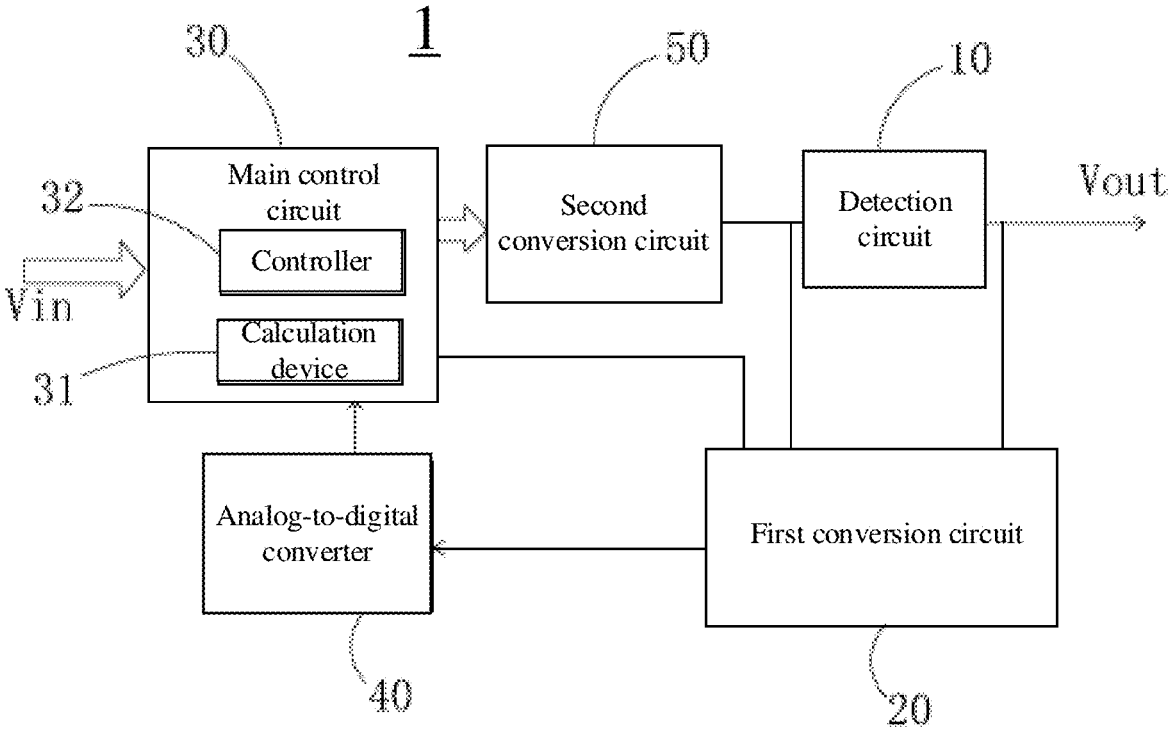
FIG. 1 is a schematic block diagram of an overcurrent protection module according to an embodiment.

Referring to FIG. 1, FIG. 1 is a schematic block diagram of an overcurrent protection module 1 provided in the present application. The overcurrent protection module 1 includes a first output terminal Vout, a detection circuit 10, a first conversion circuit 20 and a main control circuit 30.

The first output terminal Vout is configured for outputting a drive signal. The drive signal is an analog voltage signal of high level. The overcurrent protection module 1 is applied to a boost system. The first output terminal Vout is connected with a shift register of a display panel, the drive signal is output to the shift register through the first output terminal Vout, and the display panel is driven through the shift register.

The detection circuit 10 is connected to the first output terminal Vout and is configured for detecting an output current of the first output terminal Vout. The output current is a drive current for driving the display panel.

The first conversion circuit 20 is connected to the detection circuit 10 for converting the output current into a voltage. In this embodiment, the detection circuit 10 is a sampling resistor R, and the first conversion circuit 20 converts the output current flowing through the sampling resistor R into a voltage by detecting a voltage across the sampling resistor R. The voltage includes a first voltage and a second voltage.

The main control circuit 30 is connected to the first conversion circuit 20 and is configured for transmitting control signals to control the first conversion circuit 20 to transmit the first voltage or the second voltage to the main control circuit 30. The main control circuit 30 is further configured for calculating an effective value of the output current according to the first voltage and the second voltage, and controlling the output of the drive signal at the first output Vout according to the effective value to effectively protect the display panel. The main control circuit 30 can be directly or indirectly connected to the first output Vout.

In one embodiment, the main control circuit 30 is an MCU (Microcontroller Unit).

The drive signal includes a high level and a low level within one cycle. The control signal includes a first control signal and a second control signal. When the drive signal is converted from the low level to the high level, the main control circuit 30 transmits the first control signal to the first conversion circuit 20 to control the first conversion circuit 20 to transmit the detected first voltage of the detection circuit 10 to the main control circuit 30. When the drive signal is converted from the high level to the low level, the main control circuit 30 transmits the second control signal to the first conversion circuit 20 to control the first conversion circuit 20 to transmit the detected second voltage of the detection circuit 10 to the main control circuit 30. By detecting a voltage of the detection circuit 10 within one cycle of the drive signal, the voltage being able to reflect variation of the output current within one cycle of the drive signal, and calculating an effective value of an output current through the main control circuit 30, the output current being an current of the detection circuit 10, and the effective value of the output current being able to reflect the real state of the output current, the overcurrent protection module 1 protects the display panel according to the real state of the output current, and protects the display panel from burning down due to excessive drive current, i.e., the output current.

The main control circuit 30 is also configured for controlling the first output terminal Vout to stop outputting the drive signal when the effective value is greater than a preset value, so as to prevent the display panel from burning down due to excessive drive current.

It should be noted that a calorific value of the display panel is proportional to the effective value of the output current. When the effective value of the output current is greater than the preset value, the accumulated calorific value of the display panel will cause the display panel to burn down.

The detection circuit 10 includes a first terminal S1 and a second terminal S2.

Figure 2:
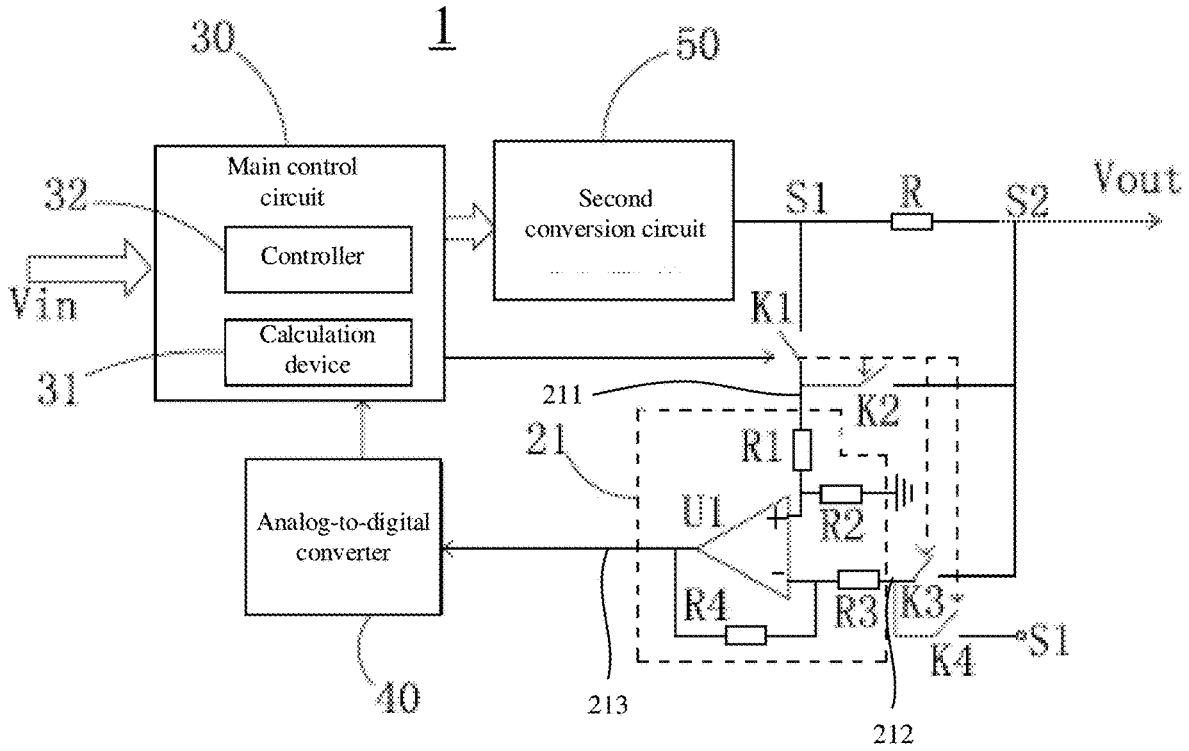
FIG. 2 is a circuit diagram of an overcurrent protection module provided according to an embodiment.

Referring to FIG. 2, in one embodiment, the first switching circuit 20 includes a first switch K1, a second switch K2, a third switch K3, a fourth switch K4, and a first detection circuit 21. The first detection circuit 21 includes a first input terminal 211, a second input terminal 212 and a second output terminal 213. The first input terminal 211 of the first detection circuit 21 is connected to the first terminal S1 of the detection circuit 10 through the first switch K1, and the first input terminal 211 is also connected to the second terminal S2 of the detection circuit 10 through the second switch K2. The second input terminal 212 of the first detection circuit 21 is connected to the second terminal S2 of the detection circuit 10 through the third switch K3, and the second input terminal 212 is also connected to the first terminal S1 of the detection circuit 10 through the fourth switch K4. The second output terminal 213 of the first detection circuit 21 is connected to the main control circuit 30.

The first control signal is configured to control the first switch K1 and the third switch K3 to turn on, and to control the second switch K2 and the fourth switch K4 to turn off. The first detection circuit 21 is configured to convert the output current to the first voltage and transmit it to the main control circuit 30

The second control signal is configured to control the first switch K1 and the third switch K3 to turn off, and to control the second switch K2 and the fourth switch K4 to turn on. The first detection circuit 21 is configured to convert the output current to the second voltage and transmit the second voltage to the main control circuit 30.

In this embodiment, the first voltage and the second voltage can be detected by the first detection circuit 21, the structure is simple and the cost is reduced.

Figure 3:
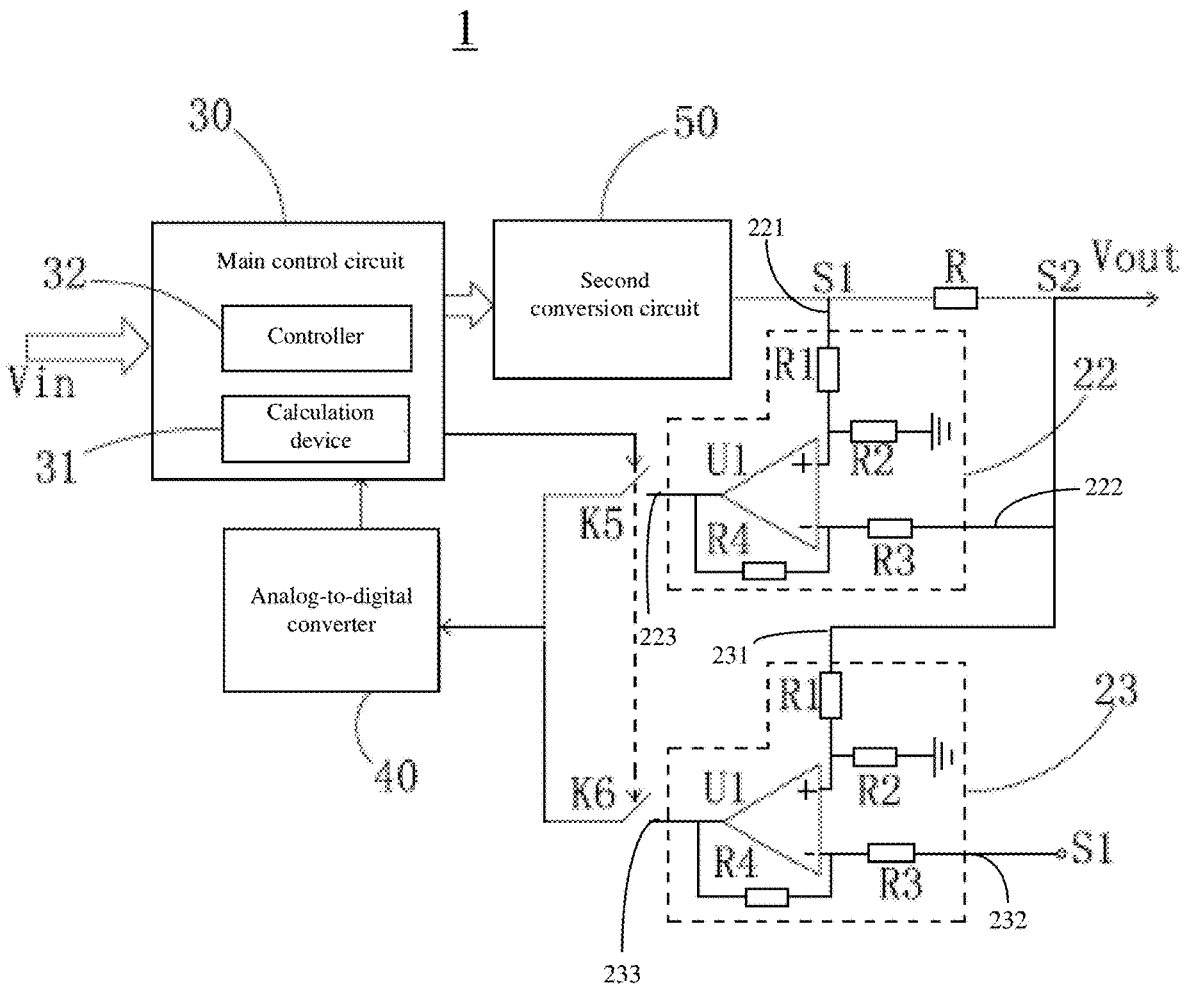
FIG. 3 is a circuit diagram of an overcurrent protection module according to another embodiment.

Referring to FIG. 3, in one embodiment, the first switching circuit 20 includes a fifth switch K5, a sixth switch K6, a second detection circuit 22, and a third detection circuit 23. The second detection circuit 22 includes a third input terminal 221, a fourth input terminal 222 and a third output terminal 223. The third input terminal 221 of the second detection circuit 22 is connected to the first terminal S1 of the detection circuit 10. The fourth input terminal 222 of the second detection circuit 22 is connected to the second terminal S2 of the detection circuit 10. The third output terminal 223 of the second detection circuit 22 is connected to the main control circuit 30 through the fifth switch K5.

The third detection circuit 23 includes a fifth input terminal 231, a sixth input terminal 232, and a fourth output terminal 233. The fifth input terminal 232 of the third detection circuit 23 is connected to the second terminal S2 of the detection circuit 10. The sixth input terminal 232 of the third detection circuit 23 is connected to the first terminal S1 of the detection circuit 10. The fourth output terminal 233 of the third detection circuit 23 is connected to the main control circuit 30 through the sixth switch K6.

The first control signal is configured to control the fifth switch K5 to turn on and the sixth switch K6 to turn off, and the second detection circuit 22 is configured to convert the output current to the first voltage and transmit the first voltage to the main control circuit 30.

The second control signal is configured to control the fifth switch K5 to turn off and the sixth switch K6 to turn on, and the third detection circuit 23 is configured to convert the output current to the second voltage and transmit the second voltage to the main control circuit 30.

In this embodiment, the second detection circuit 22 detects the first voltage and controls the fifth switch K5 to turn on and the sixth switch K6 to turn off, thereby controlling the second detection circuit 22 to transmit the first voltage to the main control circuit 30. The third detection circuit 23 detects the second voltage and controls the fifth switch K5 to turn off and the sixth switch K6 to turn on, thereby controlling the third detection circuit 23 to transmit the second voltage to the main control circuit 30. The control is simple and reliable.

Referring to FIGS. 2 and 3, in one embodiment, the first detection circuit 21, the second detection circuit 22, and the third detection circuit 23 each includes an operational amplifier U1, a first resistor R1, a second resistor R2, a third resistor R3, and a fourth resistor R4. A non-inverting input terminal U11 of the operational amplifier U1 is connected to a first terminal R11 of the first resistor R1, and a second terminal R12 of the first resistor R1 is connected to the first terminal S1 of the detection circuit 10. The non-inverting input terminal U11 of the operational amplifier U1 is also grounded through the second resistor R2. An inverting input terminal U12 of the operational amplifier U1 is connected to a first terminal R31 of the third resistor R3, and a second terminal R32 of the third resistor R3 is connected to the second terminal S2 of the detection circuit 10. The inverting input terminal U12 of the operational amplifier U1 is also connected with an output terminal U13 of the operational amplifier U1 through the fourth resistor R4. The second terminal R12 of the first resistor R1 serves as the first input terminal 211 of the first detection circuit 21, the third input terminal 221 of the second detection circuit 22 or the fifth input terminal 231 of the third detection circuit 23. The second terminal R32 of the third resistor R3 serves as the second input terminal 212 of the first detection circuit 21, the fourth input terminal 222 of the second detection circuit 22 or the sixth input terminal 232 of the third detection circuit 23. The output terminal U13 of the operational amplifier U1 serves as the second output terminal 213 of the first detection circuit 21, the third output terminal 223 of the second detection circuit 22, or the fourth output terminal 233 of the third detection circuit 23.

In one embodiment, a resistance value of the first resistor R1 is equal to a resistance value of the second resistor R2. A resistance value of the third resistor R3 is equal to a resistance value of the fourth resistor R4. A voltage at the first terminal S1 of the detection circuit 10 is V1, a voltage at the second terminal S2 of the detection circuit 10 is V2, a voltage at the non-inverting input terminal U11 of the operational amplifier U1 is V+, and a voltage at the inverting input terminal U12 of the operational amplifier U1 is V−. When the main control circuit 30 transmits the first control signal to the first conversion circuit 20, i.e., the drive signal is at the high level, V1 is greater than V2, V+=(V1)/2, and the voltage at the output terminal U13 of the operational amplifier U1 is Vout1, V+=V2−(V2−Vout1)/2=(V2+Vout1)/2. According to the operating characteristics of the operational amplifier U1, V+=V−, therefore, Vout1=V1−V2. When the main control circuit 30 transmits the second control signal to the first conversion circuit 20, i.e., the drive signal is at the low level, V2 is greater than V1, V+=(V2)/2, and the voltage at the output terminal U13 of the operational amplifier U1 is Vout2, V−=V1−(V1−Vout2)/2=(V1+Vout2)/2. According to the operating characteristics of the operational amplifier U1, V+=V−, thus Vout2=V2−V1.

Therefore, the operational amplifier U1 detects the voltage generated by the drive signal acting on the detection circuit 10 within one cycle and converts the voltage to a value greater than 0, thus facilitating the calculation of the effective value of the output current.

It should be noted that when the drive signal is at the low level, the charging of the display panel reaches a stable level, and there is reverse current flow between the display panel and the overcurrent protection module 1, i.e. V2 is greater than V1.

The overcurrent protection module 1 further includes an analog-to-digital converter 40. The analog-to-digital converter 40 is connected to the first conversion circuit 20 and the main control circuit 30, and configured for converting the first voltage or the second voltage which is an analog voltage to a digital signal and transmitting the digital signal to the main control circuit 30. The analog-to-digital converter 40 converts the first voltage and the second voltage to digital signals, so that a storage space occupied by the first voltage and the second voltage is small, and the calculation of the effective value of the output current is facilitated.

The main control circuit 30 includes a calculation device 31 and a controller 32. The calculation device 31 is connected to the analog-to-digital converter 40 for calculating the effective value of the output current according to the digital signal, so that the effective value of the output current is accurate and reliable. The controller 32 is connected to the first output terminal Vout through the detection circuit 10, and is configured for controlling the output of the drive signal of the first output terminal Vout according to the effective value, thereby effectively controlling the drive signal output by the first output terminal Vout.

The overcurrent protection module 1 further includes a signal input terminal Vin and a second conversion circuit 50.

The signal input terminal Vin is configured for receiving a low potential logic signal. The low level logic signal is a logic signal. An absolute value of a potential of the drive signal is greater than an absolute value of a potential of the low potential logic signal.

The second conversion circuit 50 is connected to the signal input terminal Vin through the main control circuit 30. The second conversion circuit 50 is also connected to the detection circuit 10 for converting the low potential logic signal into a high potential drive signal and transmitting the high potential drive signal to the first output terminal Vout through the detection circuit 10. The second conversion circuit 50 causes the drive signal output from the first output terminal Vout to have a sufficiently large voltage to drive the display panel. In one embodiment, the second conversion circuit 50 includes a potential conversion chip.

Figure 4:
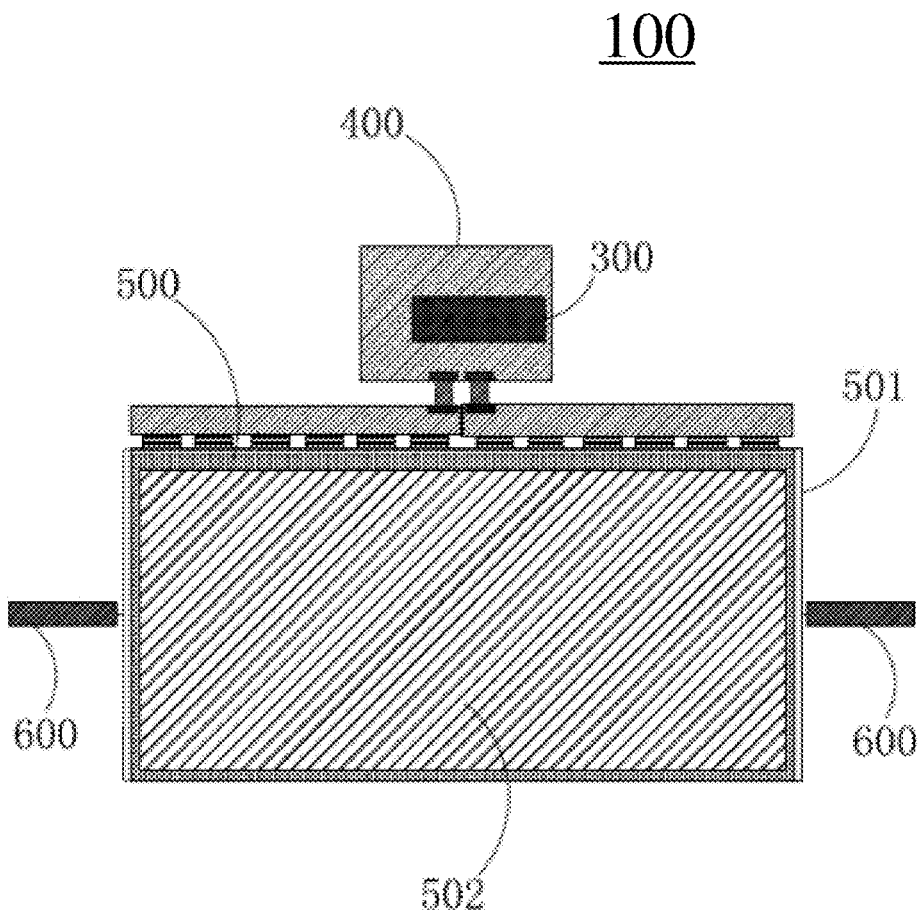
FIG. 4 is a schematic block diagram of a display device according to an embodiment.

Referring to FIG. 4, the present application also provides a display device 100 including a boost system 300, a drive circuit board 400, a display panel 500, and a shift register 600.

A GDL circuit includes the boost system 300 and the shift register 600. The boost system 300 includes the overcurrent protection module 1. The boost system 300 is disposed on the drive circuit board 400, and the shift register 600 is disposed on both sides of the display panel 500. Since the shift register 600 occupies a small area, the display panel of GDL architecture can achieve an ultra-narrow frame.

The display panel 500 includes a active array (thin film transistor, TFT) substrate 501, a color filter (CF) substrate 502, and a liquid crystal layer formed between the two substrates. The shift register 600 is disposed on the active array substrate 501.

In one embodiment, the display panel 500 is a curved display panel.

In one embodiment, active array (TFT) and color filter (CF) may be formed on a same substrate.

According to the overcurrent protection module and the display device, the voltage of the detection circuit connected to the first output terminal is detected by the first conversion circuit. Further, the output current of the first output terminal is indirectly detected, and the first voltage and the second voltage which can reflect the real state of the output current of the first output terminal respectively within one cycle of the drive signal is detected. The effective value of the output current is calculated through the first voltage and the second voltage, and then the output of the drive signal at the first output terminal is controlled according to the effective value of the output current, thus effectively protecting the display panel.

The terms "unit", "module" and "system" and etc. used in this application are intended to refer to a computer-related entity, which may be hardware, a combination of hardware and software, software, or software in execution. For example, a unit may be, but is not limited to, a process running on a processor, a processor, an object, executable codes, an executing thread, a program, and/or a computer. By way of illustration, both the applications running on a server and the server can be units. One or more units may reside in processes and/or executing threads, and the units may reside within one computer and/or be distributed in two or more computers.

Any combination of the technical features of the above-described embodiments can be made, and all possible combinations of the technical features of the above-described embodiments have not been described for simplifying the description. However, as long as there is no contradiction in a combination of these technical features, it should be considered that the combination falls in the scope of the present specification.

The above-described embodiments only illustrate several embodiments of the present application, and their description is relatively specific and detailed, however, it cannot be construed as limiting the scope of the invention patent. It should be noted that for those of ordinary skill in the art, a number of variations and improvements may be made without departing from the concepts of the present application, and all of which fall within the scope of protection of the present application. Therefore, a protection scope of the patent application shall be subject to the appended claims.

What is claimed is:

1. An overcurrent protection module, comprising:

a first output terminal configured to output a drive signal;

a detection circuit connected with the first output terminal and configured to detect an output current of the first output terminal;

a first conversion circuit connected with the detection circuit and configured to convert the output current to a voltage, wherein the voltage comprises a first voltage and a second voltage; and a main control circuit connected with the first conversion circuit and configured to transmit a control signal to control the first conversion circuit to transmit the first voltage or the second voltage to the main control circuit;

wherein the main control circuit is further configured to calculate an effective value of the output current according to the first voltage and the second voltage, and control the output of the drive signal at the first output terminal according to the effective value.

2. The overcurrent protection module according to claim 1, wherein the main control circuit is further configured to control the first output terminal to stop outputting the drive signal when the effective value is greater than a preset value.

3. The overcurrent protection module according to claim 1, wherein the detection circuit comprises a first terminal and a second terminal, the first conversion circuit comprises a first switch, a second switch, a third switch, a fourth switch and a first detection circuit; The first detection circuit comprises:

a first input terminal connected with the first terminal of the detection circuit through the first switch and connected with the second terminal of the detection circuit through the second switch;

a second input terminal connected with the second terminal of the detection circuit through the third switch and connected with the first terminal of the detection circuit through the fourth switch; and a second output terminal connected with the main control circuit;

the control signal comprises a first control signal and a second control signal;

the first control signal is configured to control the first switch and the third switch to turn on, and control the second switch and the fourth switch to turn off, the first detection circuit is configured to convert the output current to the first voltage and transmit the first voltage to the main control circuit;

the second control signal is configured to control the first switch and the third switch to turn off, and control the second switch and the fourth switch to turn on, and the first detection circuit is configured to convert the output current to the second voltage and transmit the second voltage to the main control circuit.

4. The overcurrent protection module according to claim 3, wherein the detection circuit comprises a first terminal and a second terminal; the first conversion circuit comprises a fifth switch, a sixth switch, a second detection circuit and a third detection circuit;

the second detection circuit comprises:

a third input terminal connected to the first terminal of the detection circuit;

a fourth input terminal connected to the second terminal of the detection circuit; and a third output terminal connected with the main control circuit through the fifth switch;

the third detection circuit comprises:

a fifth input terminal connected to the second terminal of the detection circuit;

a sixth input terminal connected to the first terminal of the detection circuit; and a fourth output terminal connected with the main control circuit through the sixth switch;

the first control signal is configured to control the fifth switch to turn on and the sixth switch to turn off, and the second detection circuit is configured to convert the output current to the first voltage and transmit the first voltage to the main control circuit;

the second control signal is configured to control the fifth switch to turn off and the sixth switch to turn on, and the third detection circuit is configured to convert the output current to the second voltage and transmit the second voltage to the main control circuit.

5. The overcurrent protection module according to claim 3, wherein the first detection circuit comprises an operational amplifier, a first resistor, a second resistor, a third resistor and a fourth resistor; a non-inverting input terminal of the operational amplifier is connected with a first terminal of the first resistor, a second terminal of the first resistor is connected with the first terminal of the detection circuit, the non-inverting input terminal of the operational amplifier is grounded through the second resistor, an inverting input terminal of the operational amplifier is connected with a first terminal of the third resistor, a second terminal of the third resistor is connected to the second terminal of the detection circuit, the inverting input terminal of the operational amplifier is connected with an output terminal of the operational amplifier through the fourth resistor, the second terminal of the first resistor serving as the first input terminal of the first detection circuit, the second terminal of the third resistor serving as the second input terminal of the first detection circuit, and the output terminal of the operational amplifier serving as the second output terminal of the first detection circuit.

6. The overcurrent protection module according to claim 4, wherein the second detection circuit comprises an operational amplifier, a first resistor, a second resistor, a third resistor and a fourth resistor; a non-inverting input terminal of the operational amplifier is connected with a first terminal of the first resistor, a second terminal of the first resistor is connected to the first terminal of the detection circuit, the non-inverting input terminal of the operational amplifier is grounded through the second resistor, an inverting input terminal of the operational amplifier is connected with a first terminal of the third resistor, a second terminal of the third resistor is connected to the second terminal of the detection circuit, the inverting input end of the operational amplifier is also connected with an output end of the operational amplifier through the fourth resistor, the second terminal of the first resistor serving as the third input terminal of the second detection circuit, the second terminal of the third resistor serving as the fourth input terminal of the second detection circuit, and the output terminal of the operational amplifier serving as the third output terminal of the second detection circuit.

7. The overcurrent protection module according to claim 4, wherein the third detection circuit comprises an operational amplifier, a first resistor, a second resistor, a third resistor, and a fourth resistor; a non-inverting input terminal of the operational amplifier is connected with a first terminal of the first resistor, a second terminal of the first resistor is connected to the first terminal of the detection circuit, the non-inverting input terminal of the operational amplifier is grounded through the second resistor, an inverting input terminal of the operational amplifier is connected with a first terminal of the third resistor, a second terminal of the third resistor is connected to the second terminal of the detection circuit, the inverting input terminal of the operational amplifier is connected with an output terminal of the operational amplifier through the fourth resistor, the second terminal of the first resistor serving as the fifth input terminal of the third detection circuit, the second terminal of the third resistor serving as the sixth input terminal of the third detection circuit, and the output terminal of the operational amplifier serving as the fourth output terminal of the third detection circuit.

8. The overcurrent protection module according to claim 7, wherein a resistance value of the first resistor is equal to a resistance value of the second resistor.

9. The overcurrent protection module according to claim 7, wherein a resistance value of the third resistor is equal to a resistance value of the fourth resistor.

10. The overcurrent protection module according to claim 1, further comprising an analog-to-digital converter connected with the first conversion circuit and the main control circuit and configured to convert the first voltage or the second voltage which is an analog voltage to a digital signal and transmit the digital signal to the main control circuit.

11. The overcurrent protection module according to claim 10, wherein the main control circuit comprises a calculation device connected to the analog-to-digital converter and configured to calculate the effective value of the output current based on the digital signal.

12. The overcurrent protection module according to claim 1, wherein the main control circuit further comprises a controller configured to control the output of the drive signal at the first output terminal according to the effective value.

13. The overcurrent protection module according to claim 1, further comprising:

a signal input terminal configured to receive a low potential logic signal; and a second conversion circuit connected with the signal input terminal through the main control circuit, the second conversion circuit being connected with the detection circuit, and configured to convert the low potential logic signal to a high potential drive signal and transmit the high potential logic signal to the first output terminal through the detection circuit.

14. The overcurrent protection module according to claim 13, wherein an absolute value of a potential of the drive signal is greater than an absolute value of a potential of the low potential logic signal.

15. The overcurrent protection module according to claim 1, wherein the detection circuit is a sampling resistor.

16. The overcurrent protection module according to claim 1, wherein the main control circuit is a micro-controller.

17. An overcurrent protection module, comprising:

a first output terminal configured to output a drive signal;

a detection circuit connected with the output terminal and configured to detect an output current of the first output terminal;

a first conversion circuit connected with the detection circuit and configured to convert the output current to a voltage, wherein the voltage includes a first voltage and a second voltage;

a main control circuit connected with the first conversion circuit and configured to transmit a control signal to control the first conversion circuit to transmit the first voltage or the second voltage to the main control circuit; and an analog-to-digital converter connected with the first conversion circuit and the main control circuit, and configured to convert the first voltage or the second voltage which is an analog voltage to a digital signal and transmit the digital signal to the main control circuit;

wherein the main control circuit is further configured to calculate an effective value of the output current according to the first voltage and the second voltage, and control the output of the drive signal at the first output terminal according to the effective value.

18. A display device, comprising:

a drive circuit board;

a boost system disposed on the drive circuit board and comprising:

an overcurrent protection module comprising:

a first output terminal configured to output a drive signal;

a detection circuit connected with the first output terminal and configured to detect an output current of the first output terminal;

a first conversion circuit connected with the detection circuit and configured to convert the output current to a voltage, wherein the voltage comprises a first voltage and a second voltage; and a main control circuit connected with the first conversion circuit and configured to transmit a control signal to control the first conversion circuit to transmit the first voltage or the second voltage to the main control circuit, calculate an effective value of the output current according to the first voltage and the second voltage, and control the output of the drive signal at the first output terminal according to the effective value;

a display panel; and a shift register disposed on both sides of the display panel.

* * * * *